US007939487B2

(12) United States Patent
Scheuing et al.

(10) Patent No.: US 7,939,487 B2
(45) **Date of Patent: *May 10, 2011**

(54) NATURAL CLEANERS

(75) Inventors: David R. Scheuing, Danville, CA (US); Nancy Ann Falk, Livermore, CA (US); David Jackson Lestage, Livermore, CA (US); Erika Szekeres, San Ramon, CA (US); Sukhvinder Kaur, Dublin, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/558,831

(22) Filed: Sep. 14, 2009

(65) Prior Publication Data

US 2010/0056416 A1 Mar. 4, 2010

Related U.S. Application Data

(63) Continuation-in-part of application No. 12/198,677, filed on Aug. 26, 2008, now Pat. No. 7,608,573, and a continuation-in-part of application No. 12/198,685, filed on Aug. 26, 2008, now Pat. No. 7,629,305.

(51) Int. Cl.

| | |
|---|---|
| ***C11D 1/12*** | (2006.01) |
| ***C11D 1/75*** | (2006.01) |
| ***C11D 3/22*** | (2006.01) |
| ***C11D 3/43*** | (2006.01) |

(52) U.S. Cl. ..... 510/340; 510/331; 510/342; 510/350; 510/351; 510/360; 510/426; 510/433; 510/437; 510/474; 510/481; 510/492; 510/499; 510/503

(58) Field of Classification Search ..... 510/331, 510/340, 342, 350, 351, 360, 426, 433, 437, 510/474, 481, 492, 499, 503

See application file for complete search history.

(56) References Cited

U.S. PATENT DOCUMENTS

| | | | | |
|---|---|---|---|---|
| 6,004,915 | A * | 12/1999 | Elliott | |
| 6,060,440 | A * | 5/2000 | Sackariasen | |
| 6,117,820 | A * | 9/2000 | Cutler | |
| 6,121,228 | A * | 9/2000 | Drapier | |
| 6,537,960 | B1 * | 3/2003 | Ruhr | |
| 6,686,323 | B2 * | 2/2004 | Nilsson | |
| 6,759,382 | B2 * | 7/2004 | Ahmed | 510/424 |
| 7,511,006 | B2 * | 3/2009 | Shimmin | |
| 7,608,573 | B1 * | 10/2009 | Scheuing et al. | 510/331 |
| 7,618,931 | B1 * | 11/2009 | Scheuing et al. | 510/340 |
| 7,629,305 | B1 * | 12/2009 | Szekeres et al. | 510/331 |
| 2005/0233938 | A1 * | 10/2005 | Delplancke | |
| 2006/0100128 | A1 * | 5/2006 | McCue | |
| 2006/0172889 | A1 * | 8/2006 | Barnes | |
| 2006/0258541 | A1 * | 11/2006 | Crews | |
| 2009/0054294 | A1 * | 2/2009 | Theiler | |

FOREIGN PATENT DOCUMENTS

| | | | |
|---|---|---|---|
| WO | WO 00/49095 | * | 8/2000 |
| WO | WO 09/07166 | * | 1/2009 |
| WO | WO 09/24747 | * | 2/2009 |
| WO | WO 2010/027608 | * | 3/2010 |

* cited by examiner

*Primary Examiner* — Brian P Mruk
(74) *Attorney, Agent, or Firm* — Alok Goel

(57) ABSTRACT

A cleaning composition with a limited number of natural ingredients contains an anionic surfactant, a hydrophilic syndetic, nonionic surfactant and a hydrophobic syndetic. The cleaning composition can be used to clean laundry, soft surfaces, and hard surfaces and cleans as well or better than commercial compositions containing synthetically derived cleaning agents.

12 Claims, No Drawings

NATURAL CLEANERS

CROSS-REFERENCES TO RELATED APPLICATIONS

This application is a continuation-in-part of both applications U.S. Ser. No. 12/198,677 , now U.S. Pat. No. 7,608,573 and U.S. Ser. No. 12/198,685, now U.S. Pat. No. 7,629,305, both filed on Aug. 26, 2008, all of which are incorporated herein by reference.

BACKGROUND OF THE INVENTION

1. Field of the Invention

The present invention relates generally to naturally based cleaners. Natural based cleaners include, but are not limited to, laundry detergents, soil and stain removers, light duty liquid detergents, all-purpose cleaners, and glass cleaners.

2. Description of the Related Art

Cleaning formulations have progressed and created a large chemical industry devoted to developing new synthetic surfactants and solvents to achieve ever improving cleaning compositions for the consumer. Because of a desire to use renewable resources, natural based cleaners are gaining increasing interest. Most of these cleaners contain only some natural ingredients. One difficulty in formulating natural based cleaners is achieving acceptable consumer performance with a limited number of natural components compared to highly developed formulations using synthetic surfactants and solvents.

Typical cleaning formulations require multiple surfactants, solvents, and builder combinations to achieve adequate consumer performance. Because of the increased cost of synthetic sources for cleaning agents and a concern for the environment, there is renewed focus on using materials that are naturally sourced.

For example, U.S. Pat. No. 6,759,382 to Ahmed discloses a concentrated liquid detergent composition containing a primary surfactant system chosen from alkylbenzene sulfonate or another sulfate or sulfonate and a secondary surfactant system containing an α-sulfomethyl ester or alkyl polyglucoside, where the alkyl polyglucoside is a $C_8$ to $C_{16}$ alkylpolyglucoside, a $C_8$ to $C_{10}$ alkylpolyglucoside, a $C_8$ to $C_{14}$ alkylpolyglucoside, a $C_{12}$ to $C_{14}$ alkylpolyglucoside, or a $C_{12}$ to $C_{16}$ alkylpolyglucoside. U.S. Pat. No. 6,686,323 to Nilsson et al. discloses $C_6$, $C_8$ and $C_{10}$ alkylpolyglucosides as surfactant for mud removal in oil drilling. U.S. Pat. No. 6,117,820 to Cutler et al. discloses agricultural formulations containing $C_8$ to $C_{10}$ alkylpolyglucosides, $C_9$ to $C_{11}$ alkylpolyglucosides, and 2-ethyl-1-hexylglucoside. U.S. Pat. App. 20060172889 to Barnes et al. discloses agricultural formulations containing $C_7$ to $C_{18}$ alkylpolyglucosides. U.S. Pat. No. 6,537,960 to Ruhr et al. discloses $C_6$ and $C_8$ alkylpolyglucosides in highly alkaline formulations with amine oxides and alcohol alkoxylates. PCT App. WO 00/49095 to Landeweer et al. discloses $C_6$ to $C_{10}$ alkylpolyglucosides with glycol ethers such as butyl diglycol.

Prior art compositions do not combine effective cleaning with a minimum number of ingredients, especially with natural ingredients. It is therefore an object of the present invention to provide a cleaning composition that overcomes the disadvantages and shortcomings associated with prior art cleaning compositions.

SUMMARY OF THE INVENTION

In accordance with the above objects and those that will be mentioned and will become apparent below, one aspect of the present invention comprises a natural cleaning composition consisting essentially of an anionic surfactant selected from the group consisting of sodium lauryl sulfate, sodium alkyl α-sulfomethyl ester, and combinations thereof; a hydrophilic syndetic selected from a $C_6$ alkylpolyglucoside; a nonionic surfactant selected from an alkylpolyglucosides having chain lengths greater than $C_8$, a hydrophobic syndetic selected from a fatty acid; pH 7-13; optionally a solvent selected from the group consisting of propylene glycol, 1,3-propanediol, ethanol, sorbitol, glycerol and combinations thereof; optionally an organic chelating agent from the group consisting of 2-hydroxyacids, 2-hydroxyacid derivatives, glutamic acid, glutamic acid derivatives, and mixtures thereof, and optional ingredients selected from glycerol, pH adjusting agents, calcium salts, boric acid or borate, enzymes, dyes, colorants, fragrances, preservatives, fluorescent whitening agents, blueing agents, defoamers, bleaches, and thickeners.

In accordance with the above objects and those that will be mentioned and will become apparent below, another aspect of the present invention comprises a natural cleaning composition consisting essentially of an anionic surfactant selected from the group consisting of a fatty alcohol sulfate, an alkyl α-sulfomethyl ester, a disodium α-sulfo fatty acid salt and combinations thereof, a hydrophilic syndetic selected from the group consisting of $C_6$ alkylpolyglucoside, $C_6$ to $C_8$ alkylpolyglucoside, $C_8$ alkylpolyglucoside, $C_6$ to $C_8$ alkyl sulfate, $C_4$ to $C_8$ alkyl polypentoside, and combinations thereof, a nonionic surfactant selected from the group consisting of alkylpolyglucoside having chain lengths from $C_{10}$ to $C_{20}$, a $C_8$ to $C_{14}$ alkyl poly-pentoside, an alkyl poly (glycerol ether), and combinations thereof; a hydrophobic syndetic selected from the group consisting of an amine oxide, an amidoamine oxide, a fatty acid, a fatty alcohol, a sterol, a sorbitan fatty acid ester, a glycerol fatty acid ester, and combinations thereof; optionally a solvent selected from the group consisting of propylene glycol, 1,3-propanediol, ethanol, sorbitol, glycerol and combinations thereof; optionally an organic chelating agent from the group consisting of 2-hydroxyacids, 2-hydroxyacid derivatives, glutamic acid, glutamic acid derivatives, and mixtures thereof, and optional ingredients selected from glycerol, pH adjusting agents, alkanolamines, calcium salts, boric acid, enzymes, dyes, colorants, fragrances, preservatives, fluorescent whitening agents, blueing agents, defoamers, bleaches, thickeners.

In accordance with the above objects and those that will be mentioned and will become apparent below, another aspect of the present invention comprises a natural cleaning composition comprising an anionic surfactant selected from the group consisting of sodium lauryl sulfate, sodium alkyl α-sulfomethyl ester, a disodium α-sulfo fatty acid salt and combinations thereof, a hydrophilic syndetic selected from the group consisting of $C_6$ alkylpolyglucoside, $C_6$ to $C_8$ alkylpolyglucoside, $C_8$ alkylpolyglucoside, $C_6$ to $C_8$ alkyl sulfate, $C_4$ to $C_8$ alkyl polypentoside and combinations thereof, a nonionic surfactant selected from the group consisting of alkylpolyglucoside having chain lengths from $C_{10}$ to $C_{20}$, a $C_8$ to $C_{14}$ alkyl polypentoside, an alkyl poly(glycerol ether), and combinations thereof, and a hydrophobic syndetic selected from the group consisting of an amine oxide, an amidoamine oxide, a fatty acid, a fatty alcohol, a sterol, a sorbitan fatty acid ester, a glycerol fatty acid ester, a polyglycerol fatty acid ester, a $C_{14}$ to $C_{22}$ alkyl polypentoside, and combinations thereof, and optionally a solvent selected from the group consisting of propylene glycol, 1,3-propanediol, ethanol, sorbitol, glycerol and combinations thereof.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes cationic, anionic, nonionic zwitterionic and/or amphoteric agents.

The term "base surfactant", as used herein, refers to a surfactant or amphiphile that exhibits a strong tendency to adsorb at interfaces in a relatively ordered fashion, oriented perpendicular to the interface.

The term "syndetic" (meaning to join or link together, as in mixing water and oil), as used herein, is a relatively weak amphiphile which exhibits a significant ability to adsorb at an oil-water interface (from either the water phase, hence a "hydrophilic syndetic", or from the oil phase, hence a "hydrophobic syndetic") only when the interface already bears an adsorbed layer of an ordinary surfactant or mixture of surfactants. Adsorption of syndetics at oil-water interfaces is thought to affect the spacing and order of the adsorbed ordinary surfactants in a manner that is highly beneficial to the production of very low oil-water interfacial tensions, which in turn increases the solubilization of oils and/or the removal of oils from solid surfaces.

The term "Interfacial Tension ("IFT")" refers to the excess surface free energy of the molecules residing at the interface of two immiscible phases, e.g., an aqueous phase and an oily phase, relative to that of the bulk phase(s). The concept of IFT is well known to those skilled in the art, and has been extensively discussed in references, such as C. A. Miller, P. Neogi: Interfacial Phenomena—Equilibrium and Dynamic Effects, 2nd. Ed., Surfactant Science Series, Vol. 139, 2007, CRC Press.

The term "Renewable Carbon Index ("RCI")" refers to the fraction (or percentage) of the carbon atoms in the average structure of, for example, an anionic surfactant, hydrophilic syndetic, hydrophobic syndetic or solvent which are derived from feedstocks other than petroleum or natural gas. Typically, and desirably, when such components of cleaners are produced from natural materials or in a sustainable manner, the RCI will be in excess of 0.75 or "75%", due to the use of materials found in nature, or to the use of feedstocks derived from sustainable sources such as plants, fungi or algae, products of bacterial fermentation processes, or products of treatments of plant-, fungal- or algae-derived biomass. The major challenges in the formulation of cleaners with desirably high RCIs are the selection of a few suitable materials that are economically viable, while delivering performance that is as good as or better than the conventional products.

The term "total syndetics" refers to the sum of the weight percentages of hydrophilic syndetics and hydrophobic syndetics in a composition.

The term "total base surfactant" refers to the sum of the weight percentages of anionic surfactant and any applicable nonionic and/or amphoteric surfactants in the composition.

The term "comprising", which is synonymous with "including," "containing," or "characterized by," is inclusive or open-ended and does not exclude additional, unrecited elements or method steps. See MPEP 2111.03. See, e.g., *Mars Inc. v. H.J. Heinz Co.,* 377 F.3d 1369, 1376, 71 USPQ2d 1837, 1843 (Fed. Cir. 2004) ("like the term 'comprising,' the terms 'containing' and 'mixture' are open-ended."). *Invitrogen Corp. v. Biocrest Mfg., L.P.,* 327 F.3d 1364, 1368, 66 USPQ2d 1631, 1634 (Fed. Cir. 2003) ("The transition 'comprising' in a method claim indicates that the claim is open-ended and allows for additional steps."); *Genentech, Inc. v. Chiron Corp.,* 112 F.3d 495, 501, 42 USPQ2d 1608, 1613 (Fed. Cir. 1997) See MPEP 2111.03. ("Comprising" is a term of art used in claim language which means that the named elements are essential, but other elements may be added and still form a construct within the scope of the claim.); *Moleculon Research Corp. v. CBS, Inc.,* 793 F.2d 1261, 229 USPQ 805 (Fed. Cir. 1986); *In re Baxter,* 656 F.2d 679, 686, 210 USPQ 795, 803 (CCPA 1981); *Ex parte Davis,* 80 USPQ 448, 450 (Bd. App. 1948). See MPEP 2111.03.

The term "consisting essentially of" as used herein, limits the scope of a claim to the specified materials or steps "and those that do not materially affect the basic and novel characteristic(s)" of the claimed invention. *In re Herz,* 537 F.2d 549, 551-52, 190 USPQ 461, 463 (CCPA 1976) (emphasis in original).

The term "consisting of," as used herein, excludes any element, step, or ingredient not specified in the claim. In re Gray 53 F.2d 520, 11 USPQ 255 (CCPA 1931); Ex Parte Davis, 80 USPQ 448, 450 (Bd. App. 1948). See MPEP 2111.03.

The term "natural" as used herein is meant to mean at least 95% of the components of the product are derived from plant and mineral based materials. Also, the "natural" product is biodegradable. Additionally, the "natural" product is minimally toxic to humans and has a LD50>5000 mg/kg. The "natural" product does not contain of any of the following:

non-plant based ethoxylated surfactants, linear alkylbenzene sulfonates ("LAS"), ether sulfate surfactants or nonylphenol ethoxylate (NPE).

The term "ecofriendly" as used herein is meant to mean at least 99% of the components of the product are derived from plant and mineral based materials. Also, the "ecofriendly" product is biodegradable. Additionally, the "ecofriendly" product is minimally toxic to humans and has a LD50>5000 mg/kg. The "ecofriendly" product does not contain of any of the following: non-plant based ethoxylated surfactants, linear alkylbenzene sulfonates ("LAS"), ether sulfates surfactants or nonylphenol ethoxylate (NPE).

The term "biodegradable" as used herein is meant to mean microbial degradation of carbon containing materials. The "biodegradable" material must be tested under a recognized protocol and with tested methods of established regulatory bodies such as: EPA, EPA-TSCA, OECD, MITI or other similar or equivalent organizations in the US or internationally. Suitable non-limiting examples of test methods for biodegradation include: OECD methods in the 301-305 series. Generally, all "biodegradable" material must meet the following limitations:

a) removal of dissolved organic carbon >70% b) biological oxygen demand (BOD) >60% c) % of BOD of theoretical oxygen demand >60% d) % CO2 evolution of theoretical >60%

Syndetics Technology

The compositions can contain a primary anionic surfactant, a nonionic surfactant, a hydrophilic syndetic, and a hydrophobic syndetic. Alternately, the compositions can contain a nonionic surfactant, a hydrophilic syndetic, and a hydrophobic syndetic. One key component of the invention is the short-chain hydrophilic syndetic, which can interact with the other components to give very low interfacial tension (IFT). The short-chain hydrophilic syndetic is preferably a $C_6$ alkyl polyglucoside, a $C_6$ to $C_8$ alkyl polyglucoside, or a $C_8$ alkyl polyglucoside. Alternative suitable hydrophilic syndetics are $C_6$ alkyl sulfate, $C_6$ to $C_8$ alkyl sulfate, or $C_4$ to $C_8$ alkyl polypentoside. The alkyl polypentosides are materials of desirably high RCI in which the hydrophilic groups are derived from raw material sources such as wheat bran and straw. Such biomass-based sources, when refined yield syrups that are enriched in pentoses, or 5 carbon sugars, such as arabinese and xylose. Glycoslylation of pentoses with alcohols is readily accomplished, adding the hydrophobic alkyl groups which endow the resulting materials with interfacial activity. Preferably, the alkyl chains are derived from fatty alcohols which are derived from a natural source, such as coconut or palm oil, or sugar beets, or distilled cuts of fatty alcohols from such plant-based materials. Condensation reactions between the hydrophilic pentoses may occur during synthesis of the interfacially active materials, thus producing practical final materials than can be described as alkyl polypentosides. In order for these materials to function as hydrophilic syndetics, the alkyl chains should be relatively short, that is the average chain length should be from 4 to 8 carbon atoms.

Primary Anionic Surfactant

In one embodiment of the invention the primary anionic surfactant is a fatty alcohol sulfate having a $C_{12}$ or longer chain, for example sodium lauryl sulfate. Typical alkyl sulfate surfactants are water soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like).

In another embodiment of the present invention, the anionic surfactant is an α-sulfomethyl ester (MES). In a suitable embodiment, the α-sulfomethyl ester salt is a α-sulfomethyl ester of a fatty acid and can be chosen from a $C_{12}$-$C_{18}$ sodium methyl α-sulfomethyl ester and a $C_{12}$-$C_{18}$ disodium α-sulfo fatty acid salt. Because more than one α-sulfomethyl ester may be present, the present invention contemplates the use of both sodium methyl α-sulfomethyl ester and the disodium α-sulfo fatty acid salt in the secondary surfactant system. Commercially available sodium α-sulfomethyl esters that may be used in accordance with the present invention include ALPHA-STEP® ML-40 and ALPHA-STEP® MC-48, both sold by Stepan Company. A mixture of sodium methyl 2-sulfolaurate and disodium 2-sulfolaurate is preferred.

Other anionic materials include alkanoyl sarcosinates corresponding to the formula $R^1CON(CH_3)—CH_2CH_2—CO_2M$ wherein $R^1$ is a saturated or unsaturated, branched or unbranched alkyl or alkenyl group of about 10 to about 20 carbon atoms, and M is a water-soluble cation. Nonlimiting examples of which include sodium lauroyl sarcosinate, sodium cocoyl sarcosinate, and ammonium lauroyl sarcosinate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting examples of which include sodium cocoyl lactylate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting examples of which include sodium cocoyl lactylate. Other anionic materials include acyl glutamates corresponding to the formula $R^1CO—N(COOH)—CH_2CH_2—CO_2M$ wherein $R^1$ is a saturated or unsaturated, branched or unbranched alkyl or alkenyl group of about 8 to about 24 carbon atoms, and M is a water-soluble cation. Nonlimiting examples of which include sodium lauroyl glutamate and sodium cocoyl glutamate. Other anionic materials include the carboxylates, nonlimiting examples of which include sodium lauroyl carboxylate, sodium cocoyl carboxylate, and ammonium lauroyl carboxylate. Also useful are taurates which are based on taurine, which is also known as 2-aminoethanesulfonic acid. Examples of taurates include N-alkyltaurines such as the one prepared by reacting dodecylamine with sodium isethionate according to the teaching of U.S. Pat. No. 2,658,072 which is incorporated herein by reference in its entirety. Other examples based of taurine include the acyl taurines formed by the reaction of n-methyl taurine with fatty acids (having from about 8 to about 24 carbon atoms). Other anionic surfactants include glutamates, such as sodium or triethyl-ammonium cocoyl glutamate, and glycinates, such as potassium cocoyl glycinate.

Other anionic surfactants which can be useful in the formulation of an anionic base surfactant package include alkyl sulfosuccinates. Also useful are disodium coco polyglucose citrate, sodium cocopolyglucose tartrate, and disodium cocopolyglucose sulfosuccinate, all available from, for example, Jan Dekker (UK) Ltd.

Besides sodium other salts can include, for example, potassium, ammonium, and lithium salts of the anionic surfactant. The anionic surfactant is typically present in 0.1 to 50%, or 0.1 to 30%, or 0.1 to 20%, or 1 to 20%, 3 to 20%.

Nonionic Surfactants

In one embodiment of the invention the cleaning compositions can contain alkanol amides, and fatty acid amine surfactants. A suitable alkanolamide is a lower alkanolamide of a higher alkanoic acid, for example a mono-alkanolamide chosen from lauryl/myristic monoethanolamide and coco monoethanolamide from Stepan Company®.

In one embodiment of the invention the cleaning compositions contain one or more alkyl polyglucoside surfactants. The alkyl polyglucoside surfactant preferably has a naturally derived alkyl substituent, such as coconut fatty alcohol or a distilled cut of a natural fatty alcohol. The alkyl polyglucoside is preferably made from renewable resources and preferably has no petroleum derived components, such as ethoxylate or propoxylate. Preferable alkyl chain lengths for the primary nonionic surfactant are $C_{10}$ to $C_{20}$; any portion of the added alkyl polyglucoside that has lower alkyl chain lengths can be a hydrophilic syndetic, such as a $C_8$ to $C_{16}$ alkylpolyglucoside, a $C_8$ to $C_{10}$ alkylpolyglucoside, a $C_8$ to $C_{14}$ alkylpolyglucoside, a $C_{12}$ to $C_{14}$ alkylpolyglucoside, or a $C_{12}$ to $C_{16}$ alkylpolyglucoside, for example.

Suitable alkyl polyglucoside surfactants are the alkylpolysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g. , a polyglycoside (polyglucoside), hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkylglucoside surfactants include, for example, Glucopon 425® (a coconut alkyl polyglucoside having naturally derived components available from Cognis Corporation), Glucopon 625® (a $C_{10}$-$C_{16}$ alkyl polyglucoside available from Cognis Corporation), Dow Triton® CG110 (a $C_8$-$C_{11}$ alkyl polyglucoside available from Dow Chemical Company), AG6202® (a $C_8$ alkyl polyglucoside available from Akzo Nobel) and Alkadet 15® (a $C_8$-$C_{10}$ alkyl polyglucoside available from Huntsman Corporation). In another embodiment of the invention the cleaning compositions contain one or more alkyl polypentosides. The alkyl polypentoside preferably has an alkyl chain length greater than $C_8$ and less than about $C_{14}$. Suitable alkyl polypentosides include Radia ®Easysurf 6781 (described as a $C_8$ to $C_{10}$ alkyl polypentoside, available from Oleon). Blends of alkyl polypentosides and alkyl polyglucosides, when used as the nonionic surfactant, can be particularly useful in adjustment of aesthetic parameters of formulations, such as viscosity or color.

Other suitable nonionic surfactants are the alkyl (poly glycerol ethers), in which more than one glycerol group is present. Particularly preferred are alkyl (poly glycerol ethers) in which the alkyl groups are derived from natural fatty alcohols, for example, from plant-based sources such as coconut oil, and the hydrophilic polyglycerol groups are derived from natural glycerine, which can be produced via an alkaline condensation reaction as described in U.S. Pat. No. 3,968,169. It is possible to employ mixtures of alkyl polyglucosides, alkyl polypentosides and alkyl poly (glycerol) ethers as the nonionic surfactant mixture in formulations, in combination with a hydrophilic syndetic, a hydrophobic syndetic, and an anionic base surfactant or anionic surfactant mixture, in order to optimize costs and certain aesthetic parameters such as viscosity, depending on the manufacturing location utilized.

Suitably, the nonionic surfactant is present in the cleaning composition in an amount ranging from about 0.01 to about 30 weight percent, or 0.1 to 30 weight percent, or 10 to 30 weight percent, or 1 to 5 weight percent, or 2 to 5 weight percent, or 0.5 to 5 weight percent, or 0.5 to 4 weight percent, or 0.5 to 3 weight percent, or 0.5 to 2.0 weight percent, or 0.1 to 0.5 weight percent, or 0.1 to 1.0 weight percent, or 0.1 to 2.0 weight percent, or 0.1 to 3.0 weight percent, or 0.1 to 4.0 weight percent, or greater than 2 weight percent, or greater than 3 weight percent.

The cleaning compositions preferably have an absence of other nonionic surfactants, especially petroleum derived nonionic surfactants, such as nonionics based on synthetic alcohols or ethoxylates.

The cleaning compositions does not contain the following components: The present invention does not contain the following components: alkyl glycol ethers, alcohol alkoxylates, alkyl monoglycerolether sulfate, alkyl ether sulfates, alkanolamines, alkyl ethoxysulfates, linear alkylbenzene sulfonate ("LAS"), linear alkylbenzene sulphonic acid ("HLAS"), nonylphenol ethoxylate ("NPE"), phosphates, and EDTA.

Amphoteric Surfactants

The compositions can contain amphoteric surfactants such as lecithin, alkyl betaines, alkyl sultaines, alkyl amphoacetates, alkyl amphodiacetates, alkyl amphopropionates, and alkyl amphodipropionates. Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference.

Suitably, the amphoteric surfactant is present in the cleaning composition in an amount ranging from about 0.01 to about 30 weight percent; or about 0.1 to about 30 weight percent, or about 10 to about 30 weight percent, or about 1 to about 5 weight percent, or about 0.5 to about 4 weight percent, or about 0.5 to about 3 weight percent, or about 0.5 to about 2.0 weight percent, or about 0.1 to about 0.5 weight percent, or about 0.1 to about 1.0 weight percent, or about 0.1 to about 2.0 weight percent, or about 0.1 to about 3.0 weight percent, or about 0.1 to about 4.0 weight percent, or greater than 2 weight percent, or greater than 3 weight percent.

Hydrophilic Syndetic

In one embodiment of the invention the cleaning compositions contain one or more hydrophilic syndetics. Suitable short-chain hydrophilic syndetics include a $C_6$ alkyl polyglucoside, such as AG6206®, or a $C_6$ to $C_8$ alkyl polyglucoside, such as AG6202® from Akzo-Nobel®. Other suitable short-chain hydrophilic syndetics include $C_6$ to $C_8$ alkyl sulfate, including hexyl sulfate, octyl sulfate, 2-ethylhexyl sulfate, and a $C_4$ to $C_8$ alkyl polypentoside. The alkyl chains are preferably straight chains and derived from natural oils, rather than branched chains, such as 2-ethylhexyl. These hydrophilic syndetics provide surprisingly unique interactions with anionic surfactants and nonionic surfactants to allow the compositions to go to low interfacial tensions comparable to compositions based on synthetic petrochemical feedstocks.

Where an alkyl polyglucoside or alkyl sulfate ingredient contains $C_6$ and/or $C_8$ alkyl chain lengths in addition to higher alkyl chain lengths, the portion of the ingredient containing $C_6$ and/or $C_8$ alkyl chain lengths may be considered to represent a hydrophilic syndetic component of the invention; the higher alkyl chain length portion may then be considered to represent an anionic or nonionic surfactant component of the invention, as appropriate. For example, Glucopon 425® (a coconut alkyl polyglucoside having naturally derived components available from Cognis Corporation), Dow Triton® CG110 (a $C_8$-$C_{10}$ alkyl polyglucoside available from Dow Chemical Company), and Alkadet 15® (a $C_8$-$C_{10}$ alkyl polyglucoside available from Huntsman Corporation) may be considered to contain both hydrophilic syndetic and nonionic surfactant components.

Suitably, hydrophilic syndetics are present in the cleaning composition in an amount ranging from about 0.01 to about 10 weight percent, or 0.01 to about 5 weight percent, 0.01 to 2 weight percent, or 0.01 to 1 weight percent, or 0.01 to 0.5 weight percent, or 0.01 to 0.20 weight percent.

Hydrophobic Syndetic

In one embodiment of the invention the cleaning compositions contain one or more hydrophobic syndetics. Preferred hydrophobic syndetics are fatty acids, such as oleic or palmitic acid. A fatty acid is a carboxylic acid that is often with a long unbranched aliphatic tail (chain), which is saturated or unsaturated. Fatty acids are aliphatic monocarboxylic acids, derived from, or contained in esterified form in an animal or vegetable fat, oil or wax. Natural fatty acids commonly have a chain of 4 to 28 carbons (usually unbranched and even numbered), which may be saturated or unsaturated. Saturated fatty acids do not contain any double bonds or other functional groups along the chain. The term "saturated" refers to hydrogen, in that all carbons (apart from the carboxylic acid [—COOH] group) contain as many hydrogens as possible. In contrast to saturated fatty acids, unsaturated fatty acids contain double bonds. Examples of fatty acids that can be used in the present invention, include but are not limited to, butyric acid, caproic acid, caprylic acid, capric acid, lauric acid, myristic acid, palmitic acid, stearic acid, arachdic acid, behenic acid, lignoceric acid, myristoleic acid, palmitoleic acid, oleic acid, linoleic acid, alpha-linoleic acid, arachidonic acid, eicosapentaenoic acid, erucic acid, docosahexaenoic acid or mixtures thereof. The fatty acid suitably has a primary chain length (the predominate chain length) from $C_{10}$ to $C_{18}$.

Other preferred hydrophobic syndetics are amine oxides. Suitable amine oxides include those compounds having the formula $R^3(OR^4)_xNO(R^5)2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof-, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$-$C_{18}$ alkyl dimethylamine oxide, and $C_{10}$-$C_{18}$ acylamido alkyl dimethylamine oxide. Preferred amine oxides include but are not limited to, dimethyl alkyl amine oxide, amidoamine oxide, diethyl alkyl amine oxide and combinations thereof In a more preferred embodiment, the amine oxide has $C_{12}$-$C_{18}$ alkyl chains.

Other suitable hydrophobic syndetics are glycerol and sorbitan fatty acid esters. The glyceryl alkyl or alkenyl ester (co-surfactant (iii)) is preferably a monoester of a $C_8$-$C_{22}$ carboxylic acid with glycerol. A suitable example is CITHROL GML® which is glyceryl monolaurate. The sorbitan alkyl or alkenyl ester preferably contains from 8 to 22 carbon atoms in the ester group, an especially suitable sorbitan ester is a sorbitan monolaurate such as that available under the trade name SPAN 20®. Another suitable sorbitan ester is SPAN 80®. Other suitable hydrophobic syndetics are fatty alcohols, which are the reduction product of fatty acids. Other suitable hydrophobic syndetics are sterols, especially plant sterols such as campesterol, sitosterol, stigmasterol, lanosterol, avenasterol, and cycloartenol.

Other suitable hydrophobic syndetics are the polyglycerol fatty acid esters. The fatty acids are preferably from natural, plant-based sources, and preferably contain from about 8 to 22 carbon atoms. Particularly preferred are polyglycerol fatty acid esters in which the hydrophilic polyglycerol groups are derived from the condensation of glycerine of vegetable origin. Particularly preferred polyglycerols, which can be esterified to produce the polyglycerol fatty acid esters, are Diglycerol (INCI diglycerine) and Polyglycerol-3 (INCI polyglycerine-3) available from Solvay Chemicals. Commercial polyglycerols are typically heterogeneous mixtures of diglycerol, triglycerol, and higher oligomers, including components up to about decaglycerol, as well as additional cyclic isomers. Polyglycerols with reduced cyclic isomer content have been demonstrated to exhibit superior biodegradability, thus more readily enabling the formulation of eco-friendly cleaners containing polyglycerol fatty acid esters as the hydrophobic syndetic. In addition, without being bound by theory, the kinetics of the reduction of IFT will be more rapid when there is less heterogeneity in the distribution of the polyglycerol groups of the polyglycerol fatty acid esters used as hydrophobic syndetics in the present invention. Nonlimiting examples of polyglycerol fatty acid esters suitable for use as hydrophobic syndetics include diglycerol monooleate, polyglycerol-3 monooleate, diglycerol monolaurate, polyglycerol-3 monolaurate, diglycerol stearate, polyglycerol-3 stearate, diglycerol monoricinoleate and polyglycerol-3 monoricinoleate.

Other suitable hydrophobic syndetics are the alkyl polypentosides in which the alkyl chain length is $C_{14}$ or greater, up to about $C_{22}$. A commercially available example of an alkyl polypentoside suitable as a hydrophobic syndetic is Radia ®Easysurf 6669.

Suitably, hydrophobic syndetics are present in the cleaning composition in an amount ranging from about 0.01 to about 10 weight percent, or 0.01 to about 5 weight percent, 0.01 to 2 weight percent, or 0.01 to 1 weight percent, or 0.01 to 0.5 weight percent, or 0.01 to 0.20 weight percent.

Base Surfactant

The term "base surfactant", as used herein, refers to a surfactant or amphiphile that exhibits a strong tendency to adsorb at interfaces in a relatively ordered fashion, oriented perpendicular to the interface. Anionic surfactants with hydrophobic tails longer than 10 carbon atoms and a charged ionic head group tend to act as base surfactants. A base surfactant is able to facilitate the expansion of the interface between an aqueous solution and an oily substance due to its strong tendency to adsorb at the interface, which eliminates the direct contact (on the molecular size scale) between the aqueous solution and the oily substance or oily phase, which in turn is necessary for the removal of oily soils from, for example, fabrics in laundry applications. A well-known shortcoming of surfactants (amphiphiles) that exhibit a very strong ability to adsorb at interfaces (sometimes referred to as exhibiting "strong" amphiphilicity) is the tendency to interact with themselves, as well, thereby reducing the interaction between the aqueous solution and the surfactant. When the interaction between the aqueous phase and the "self-interacting" or "self-aggregated" surfactant is inadequate the surfactant forms a separate, sometimes ill-defined coacervate-like phase, a liquid crystal phase, a vesicle phase, or a mixture of these phases, and is hence no longer available for adsorption at the interface between the aqueous phase and the oily substance or oily soil phase, and hence the detergency performance is poor. In such cases, it is then important to adjust the "strength" of the amphiphilicity of the surfactant to bring it into a preferred range, thereby achieving improved cleaning performance. It was surprisingly found that combinations of hydrophilic and hydrophobic syndetics are able to provide the necessary adjustment, and that incorporation of syndetics provides a significant improvement in the overall detergency performance of formulations that are significantly more natural and/or sustainable than those used in products currently available.

Interfacial Tension ("IFT")

One aspect of the invention involves tuning the IFT between the aqueous cleaning composition at use dilution and a suitable oil, representing the oily soil of interest. The tuning of the IFT can be achieved by selecting the appropriate ratio between the base surfactant(s) and the hydrophilic and hydrophobic syndetics. Canola oil has been found useful in representing the oily soils of significant concern to consumers in a variety of cleaning tasks, including laundering of garments and cleaning of dishes, tableware and the like. However, it is also contemplated that formulation of some natural cleaners in which the oily soil of interest could be significantly chemically different from canola oil could also specifically benefit from a tuning of the IFT via the use of hydrophilic and hydrophobic syndetics. In such cases, substitution of canola oil with a different model oil, for example, common motor oil, a mineral oil, etc. in the IFT experiments could readily be achieved by one skilled in the art. The formulations described herein below were diluted 1:1150 with water containing 100 ppm hardness for use as the aqueous phase in contact with the canola oil. Such a dilution rate corresponds to the usage rates of liquid laundry detergents with which consumers are familiar. The interfacial tensions were measured with a spinning drop tensiometer. Experimental aspects of spinning drop tensiometry have been described in A. W. Adamson and A. P. Gast: Physical Chemistry of Surfaces, $6^{th}$ ed. Wiley & Sons, Inc., New York, 1997. IFT values between the diluted formulations in hard water and the canola oil below 0.3 mN/m were found to be necessary in order for the formulations to exhibit good to excellent overall detergency performance on a wide variety of common stains a consumer might encounter on garments.

Those skilled in the art realize that the overall average surfactant mixture hydrophilicity has a direct influence on the IFT. In conventional compositions, if the surfactant mixture selected is too hydrophilic for a given oil of interest, the IFT increases, resulting in a decline in the detergency performance. Thus, a reduction in the hydrophilicity of the formulation is typically sought and an improvement in the detergency performance achieved. One of the novel features of the instant invention is that a new and surprising way becomes available to further reduce the IFT via the adjustment of the ratio between the base surfactant(s) and the total syndetic amphiphile(s). As a consequence, it is possible to decrease IFT of a formulation by increasing the concentration of the most hydrophilic component, the hydrophilic syndetic, which is in direct contrast to results obtained when the formulations contain ordinary surfactants and no syndetics. Applicants have also observed an additional benefit which, without being bound by theory, is believed to be due to the small molecular size of the hydrophilic syndetic amphiphiles used in the invention. The small hydrophilic syndetic molecules have high mobility in the aqueous environment, and consequently reach interfaces quickly and therefore achieve a rapid IFT reduction. It is believed that for improved detergency performance it is important to achieve not only a low equilibrium IFT below 0.3 mN/m, but also to achieve it quickly relative to the time scale of the particular cleaning application. Therefore, two key benefits provided by the invention are the low equilibrium IFT and the rapid IFT reduction, both of which help improve cleaning performance. These benefits can be realized by appropriately selecting the ratio of the syndetics and the base surfactant(s).

In one embodiment, the base surfactant, the hydrophilic syndetic and the hydrophobic syndetic reduce the interfacial tension between water and a canola oil below about 0.35 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.3 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.25 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.20 mN/m, as measured via spinning drop tensiometry at 25° C., in less than 15 minutes after contacting said composition with said canola oil.

Organic Chelating Agents

One aspect of the invention is a 2-hydroxycarboxylic acid or mixture of 2-hydroxycarboxylic acids or derivatives. Examples of 2-hydroxycarboxylic acids include tartaric acid, citric acid, malic acid, mandelic acid, glycolic acid, and lactic acid. 2-Hydroxycarboxylic acids also include polymeric forms of 2-hydroxycarboxylic acid, such as polylactic acid. Since other organic builders are not substantially present, significant amounts of 2-hydroxycarboxylic acids are required. The present invention can also contain, for example, gluconate as an organic chelating agent.

Suitable amino carboxylates chelating agents include ethanol-diglycines, disodium cocoyl glutamatic acid, and methyl glycine di-acetic acid (MGDA), both in their acid form, or in their alkali metal, ammonium, and substituted ammonium salt forms. Further carboxylate chelating agents for use herein include salicylic acid, aspartic acid, glutamic acid, glycine, malonic acid or mixtures and derivatives thereof.

The compositions container substantially no additional organic chelating agents. Suitable compositions comprise chelating agents in concentrations of 0.5 to 10% by weight, or 0.5 to 5% by weight, or 0.5 to 4% by weight, or 0.5 to 3% by weight, or 0.5 to 2% by weight.

Solvent

The cleaning compositions can optionally contain limited amounts of organic solvents, such as ethanol, sorbitol, glycerol, propylene glycol, glycerol, and 1,3-propanediol, for example less than 10%, or less than 5%. The compositions preferably contain solvents from natural sources rather than solvents from synthetic petrochemical sources, such as glycol ethers, hydrocarbons, and polyalkylene glycols. The compositions should be free of other organic solvents (or only trace amounts of less than 0.5% or 0.1%) including, but are not limited to, other $C_{1-6}$ alkanols, other $C_{1-6}$ diols, $C_{1-10}$ alkyl ethers of alkylene glycols, $C_{3-24}$ alkylene glycol ethers, polyalkylene glycols, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed.

Water

When the composition is an aqueous composition, water can be a predominant ingredient. The water should be present at a level of less than 90 weight percent, more preferably less than about 80 weight percent, and most preferably, less than about 70 weight percent. Deionized or filtered water is preferred.

Fragrances

The cleaning compositions can contain fragrances, especially fragrances containing essential oils, and especially fragrances containing d-limonene or lemon oil; or natural essential oils or fragrances containing d-limonene or lemon oil. Lemon oil or d-limonene helps the cleaning performance characteristics of the cleaning composition to allow suitable consumer performance with natural ingredients and a minimum of ingredients. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, the fragrance contains essential oil or lemon oil or d-limonene in the cleaning composition in an amount ranging from about 0.01 to about 0.50 weight percent, or 0.01 to 0.40 weight percent, or 0.01 to 0.30 weight percent, or 0.01 to 0.25 weight percent, or 0.01 to 0.20 weight percent, or 0.01 to 0.10 weight percent, or 0.05 to 2.0 weight percent, or 0.05 to 1.0 weight percent, or 0.5 to 1.0 weight percent, or 0.05 to 0.40 weight percent, or 0.05 to 0.30 weight percent, or 0.05 to 0.25 weight percent, or 0.05 to 0.20 weight percent, or 0.05 to 0.10 weight percent.

Natural Thickener

The present compositions can also comprise an auxiliary nonionic or anionic polymeric thickening component, especially cellulose thickening polymers, especially a water-soluble or water dispersible polymeric materials, having a molecular weight greater than about 20,000. By "water-soluble or water dispersible polymer" is meant that the material will form a substantially clear solution in water at a 0.5 to 1 weight percent concentration at 25° C. and the material will increase the viscosity of the water either in the presence or absence of surfactant. Examples of water-soluble polymers which may desirably be used as an additional thickening component in the present compositions, are hydroxyethylcellulose, hydroxypropyl cellulose, hydroxylpropyl methylcellulose, dextrans, for example Dextran purified crude Grade 2P, available from D&O Chemicals, carboxymethyl cellulose, plant exudates such as acacia, ghatti, and tragacanth, seaweed extracts such as sodium alginate, and sodium carrageenan. Preferred as the additional thickeners for the present compositions are natural polysaccharide or cellulose materials. Examples of such materials are guar gum, locust bean gum, and xanthan gum. Also suitable herein preferred is hydroxylethyl cellulose having a molecular weight of about 700,000. The thickeners are generally present in amounts of 0.05 to 2.0 weight percent, or 0.1 to 2.0 weight percent.

Dyes, Colorants and Preservatives

The cleaning compositions optionally contain dyes, colorants and preservatives, or contain one or more, or none of these components. These dyes, colorants and preservatives can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, bisguanidine compounds (e.g. Dantagard and/or Glydant). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene. The compositions can additionally contain fluorescent whitening agents or blueing agents.

Adjuncts

The cleaning compositions optionally contain one or more of the following adjuncts: enzymes such as protease, amylase, and lipase, stain and soil repellants, lubricants, odor control agents, perfumes, builders, cobuilders/soil suspension polymers, co-surfactants, fragrances and fragrance release agents, reducing agents such as sodium sulfite, and bleaching agents. Builders include, but are not limited to, zeolites, sodium chloride, potassium chloride, sulfates (i.e. magnesium sulfate), silicates (i.e. sodium polysilicate, sodium metasilicate, sodium metasilicate anhydrous, sodium aluminosilicate, potassium silicate) and carbonates. Cobuilders/soil suspension polymers include but are not limited to, carboxy methyl cellulose, carboxylated polymers (inulin, starch, polysaccharide) and poly(aspartic acid). Co-surfactants include, but are limited to, saponins and alkylamide ethanolamines. Bleaching agents include, but are not limited to, perborate, percarbonate, peroxides and mixtures thereof. Other adjuncts include, but are not limited to, acids, pH adjusting agents, electrolytes, dyes and/or colorants, solubilizing materials, stabilizers, thickeners, defoamers, hydrotropes, cloud point modifiers, preservatives, and other polymers. Electrolytes, when used, include, calcium, sodium and potassium chloride. Optional pH adjusting agents include inorganic acids and bases such as sodium hydroxide, and organic agents such as monoethanolamine, diethanolamine, and triethanolamine. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide.

In a suitable embodiment the compositions contain an effective amount one or more of the following enzymes: protease, lipase, amylase, cellulase, and mixtures thereof. Suitable enzymes are available from Novozymes®.

pH

The pH of the cleaning composition is measured at 10% dilution. The cleaning compositions can have a pH of between 7 and 13, between 2 and 13, or between 7 and 10, or between 7 and 9, or between 7.5 and 8.5.

Disinfectant or Sanitizer

The cleaning compositions contain no, or substantially no, additional disinfectants or sanitizers, such as quaternary ammonium antimicrobials or biguanides. Although the compositions may contain minor amounts of traditional antimicrobials as preservatives or other uses, the compositions are without the use of traditional quaternary ammoniom compounds or phenolics. Non-limiting examples of these quaternary compounds include benzalkonium chlorides and/or substituted benzalkonium chlorides, di(C6-C14)alkyl di short chain (C1-4 alkyl and/or hydroxylalkl) quaternaryammonium salts, N-(3-chloroallyl)hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-enzylmmonium chlorides, and mixtures thereof. Biguanide antimicrobial actives including, but not limited to polyhexamethylene biguanide hydrochloride, p-chloro-henyl biguanide; 4-chlorobenzhydryl biguanide, halogenated hexidine such as, but not limited to, chlorhexidine (1,1'-hexamethylene -bis-5-(4-chlorophenyl biguanide) and its salts are also in this class.

Surface Modifying Agents

Although the compositions contain surfactants which lower the surface energy during cleaning, the compositions generally contain no surface modifying agents, which provide a lasting surface modification to the cleaning surface. The surface modifying agents are generally polymers other than the cellulosic thickening polymers and provide spreading of the water on the surface or beading of water on the surface, and this effect is seen when the surface is rewetted and even when subsequently dried after the rewetting. Examples of surface modifying agents include polymers and co-polymers of N,N-dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides. Other examples include organosilanes and organosilicone polymers, cationic polymers, hydrophobic amphoteric polymers, nanoparticles and hydrophobic organic polymers, such as waxes.

Cleaning Substrate

The cleaning composition is generally not impregnated in a cleaning substrate. Because of the limited number of ingredients, these compositions tend to perform better when used with a substrate at the time of application or use, and not sold as a pre-wetted substrate. Examples of unsuitable substrates include, nonwoven substrates, wovens substrates, hydroentangled substrates, foams and sponges and similar materials which can be used alone or attached to a cleaning implement, such as a floor mop, handle, or a hand held cleaning tool, such as a toilet cleaning device. The terms "nonwoven" or "nonwoven web" means a web having a structure of individual fibers or threads which are interlaid, but not in an identifiable manner as in a knitted web.

Examples

The compositions are simple, natural, high performance cleaning formulations with a minimum of essential natural ingredients. Competitive cleaners are either natural and inferior in performance or contain additional ingredients that make them non-natural, such as surfactants based on nonrenewable petrochemicals. Because preservatives, dyes and colorants are used in such small amounts, these may be synthetic and the entire composition may still be characterized as natural. Preferably, the compositions contain only natural preservatives, dyes, and colorants, if any.

Table I illustrates natural heavy duty cleaners of the invention. Table II illustrates less concentrated natural heavy duty cleaners of the invention. All numbers are in weight percent of active ingredients.

TABLE I

| Natural Heavy Duty | A | B | C | D | E | F |
|---|---|---|---|---|---|---|
| Sodium lauryl sulfate | 16.6 | | 5.7 | | 10.0 | |
| MES[1] | | 11.1 | | | | 10.0 |
| Glucopon ® 600UP[2] | | | | 5.0 | 10.0 | |
| Glucopon ® 425N[3] | 7.8 | 8.0 | 2.7 | | | |
| Ammonyx LMDO[4] | 1.9 | 2.0 | 0.7 | | | |
| Ammonyx LO[5] | | | | | | 10.0 |
| AG 6206[6] | 2.9 | 1.0 | 1.0 | 2.0 | | |
| AG 6202[7] | | | | | 0.5 | 1.0 |
| Oleic Acid | 1.5 | 5.0 | 1.0 | | 0.5 | 1.0 |
| Sodium Citrate dihydrate | 3.0 | 6.0 | 2.0 | 2.0 | 1.0 | 1.0 |
| Sodium gluconate | | | | 1.0 | | |
| Boric acid | 1.5 | 1.5 | 3.0 | 3.0 | | 0.5 |
| Ca chloride | 0.1 | 0.1 | 0.1 | 0.1 | | 0.1 |
| Propylene glycol | 7.0 | 5.0 | | | | |
| Ethanol | | | 2.0 | | 5.0 | 2.0 |
| Glycerol | | | 8.0 | 10.0 | | |
| 1,3-Propane diol | | | | | | |
| Protease | 0.6 | 1.0 | 0.2 | 0.2 | 1.0 | 1.0 |
| Amylase | 0.3 | 0.6 | | | | |
| Sodium sulfite | | | 0.05 | | | |
| Dye | | | | | 0.1 | 0.1 |

TABLE I-continued

| Natural Heavy Duty | A | B | C | D | E | F |
|---|---|---|---|---|---|---|
| Preservative | 0.1 | 0.1 | 0.1 | 0.1 | 0.1 | 0.1 |
| FWA | | | | | 0.05 | |
| Thickener | | | 0.1 | 0.05 | | |
| Fragrance | 0.5 | 0.2 | 0.2 | 0.15 | 7.5 | 9.0 |
| NaOH to pH | 8.5 | 8.5 | 8.5 | 8.5 | | |
| Water | balance | balance | balance | balance | balance | balance |

[1]ALPHA-STEP ® MC-48 from Stepan Company.
[2]Coco glucoside from Cognis.
[3]from Cognis.
[4]from Lonza.
[5]from Lonza.
[6]from Akzo.
[7]from Akzo.

TABLE II

| Natural Heavy Duty | G | H | I | J | K | L |
|---|---|---|---|---|---|---|
| Sodium lauryl sulfate | 16.9 | | | | 17.5 | |
| MES | | 11.1 | 14.0 | 14.0 | | |
| Glucopon ® 625N | | | 7.0 | 7.0 | | |
| Glucopon ® 425N | 8.0 | 8.0 | | | 8.0 | 4.0 |
| Ammonyx LMDO | 2.0 | 2.0 | | | | |
| AG 6206 | 3.0 | 1.0 | 3.0 | | | |
| Hexyl sulfate | | | | | 1.0 | 3.0 |
| Oleic Acid | | | 5.0 | 5.0 | | 0.5 |
| Glycerol monooleate | 1.5 | | | | | |
| Sorbitan monooleate | | 1.5 | | | 0.5 | |
| Sodium Citrate dihydrate | | | 6.0 | 6.0 | | |
| Ca chloride | | | 0.1 | 0.1 | | |
| NaCl | | | 1.0 | 1.0 | 1.0 | 0.5 |
| Propylene glycol | | | 5.0 | 5.0 | | |
| Glycerol | 1.0 | | | | | |
| 1,3-Propane diol | | 1.0 | | | 3.0 | 3.0 |
| Preservative | 0.1 | 0.1 | 0.1 | 0.1 | | |
| Fragrance | | 0.2 | | | 0.1 | 0.1 |
| NaOH to pH | 8.5 | 8.5 | 8.5 | 8.5 | 10.0 | 7.0 |
| Water | balance | balance | balance | balance | balance | balance |

Formula A was compared for laundry wash performance with a leading commercial liquid laundry detergent containing non-natural ingredients. Stain removal was tested by washing coffee, tea, red wine, chocolate pudding, and gravy stains applied to four replicates of 100% cotton fabric at water of 93 F and 100 ppm hardness in a 12-minute wash cycle in a Whirlpool top-load washing machine and reflectance of the stains via the L,a,b scale was then converted to a stain removal percentage. Formula A was superior to commercial detergent on coffee, tea, red wine, chocolate pudding, and gravy.

Formula D was compared for pretreatment performance against a leading commercial pretreatment product containing non-natural ingredients. Formulas were evaluated in a wash study using hand applied stains on pre-scoured white cotton T-shirts. 5 mL of product was pipetted onto each stain, allowed to sit for 5 minutes, and then washed in hot water with Tide® liquid detergent and dried in a standard drier. Formula D was parity of several stains and superior to the commercial pretreatment product on wine stain.

Table III illustrates the effect of the hydrophilic syndetic in lowering the interfacial tension (IFT) of the composition for improved performance. Interfacial tension of the formulations at use dilution in the presence of 100 ppm hardness against canola oil was measured using a spinning drop tensiometer at room temperature. Composition I with the hydrophilic syndetic AG6206 achieves a lower IFT at faster times than Composition J, which doesn't have AG6206, and much faster that the commercial detergent ALL®.

TABLE III

| | IFT, 2 min | IFT, 7 min | IFT 12 min |
|---|---|---|---|
| Compositon I | 0.20 | 0.18 | 0.22 |
| Composition J | 0.26 | 0.25 | 0.28 |
| All Detergent | 0.46 | 0.32 | 0.51 |

The compositions of this invention may be of various forms, including (but not restricted to) aqueous liquids, non-aqeuous liquids, gels, foams, powders, tablets, and sachets comprising a formulation within a water-soluble film. Mixtures of forms (for example, solid particles within a liquid matrix, or encapsulated liquids within a solid or liquid matrix) are within the scope of the invention as well. Such examples are listed in Table IV.

TABLE IV

| Ingredient | M | N | O | P | Q | R | S | T |
|---|---|---|---|---|---|---|---|---|
| Product form | Aq liq. | Aq. Liq. | Nonaq. Liq. | Gel | Foam | Powder | Tablet | Sachet |
| Sodium methyl ester sulfonate | 7.5 | | | | | | | |
| Sodium lauryl sulfate | 7.5 | 3.5 | 12.8 | 3.0 | 15.0 | 10.0 | 10.0 | 12.8 |
| Sodium octyl sulfate | | 3.0 | 2.5 | 1.0 | 1.0 | 2.0 | 2.0 | 2.5 |
| C8-C10 alkylpolyglucoside | 7.0 | 7.0 | | 7.0 | 5.0 | | | |
| C12 Alkylpolyglucoside | | 7.0 | | | | 5.0 | 6.0 | |
| C6 Alkylpolyglucoside | 2.7 | | | | | | | |
| Oleic acid | 3.0 | 3.0 | 12.7 | 1.0 | | 1.5 | 2.5 | 12.7 |
| Polyglycerol ether (C14, 10 glycerin units) | | | 38.2 | | | | | 38.2 |

TABLE IV-continued

| Ingredient | M | N | O | P | Q | R | S | T |
|---|---|---|---|---|---|---|---|---|
| Lauryl/myristyl amidopropyl amine oxide | 1.7 | | | | 2.0 | | | |
| C18 polypentoside | | 1.0 | | | | | | |
| Calcium chloride | | | | | | | | |
| Sodium chloride | | | | | | | | |
| Glycerol | | | 25.5 | 5.0 | 10.0 | | | 25.0 |
| Sodium silicate | | | | | | 5.0 | | |
| Sodium carbonate | | | | | | 30.0 | 30.0 | 0.5* |
| Sodium sulfate | | | | | | 25.0 | 20.0 | |
| Sodium citrate | 1.0 | | 7.6 | 2.0 | 1.0 | | | 7.6 |
| Sodium gluconate | | 1.0 | | | | | | |
| Zeolite A | | | | | | 20.0 | 20.0 | |
| Xanthan gum | | | | 0.5 | | | | |
| Clay | | | | | | | 3.0 | |
| Water-soluble film | | | | | | | | As required |
| Fragrance | 0.5 | 0.5 | 0.5 | 0.5 | 0.5 | 0.5 | 0.5 | |
| Preservative | 0.1 | 0.1 | | 0.1 | 0.1 | | | |
| Sodium, potassium, or ammonium hydroxide (to desired pH) | | | | | | | | |
| Water (deionized) | To 100% | To 100% | — | To 100% | To 100% | — | — | — |

*as suspended speckle

Note that in examples M and N, an organic solvent is not required.

In Table V, an example formulation is disclosed wherein one added alkyl polyglucoside with a $C_8$-$C_{14}$ alkyl chain distribution serves as both the hydrophilic syndetic and the nonionic surfactant.

TABLE V

| Ingredient | Weight % |
|---|---|
| Sodium lauryl sulfate | 15.0% |
| C8-C14 alkyl polyglucoside | 5.0% |
| Lauryl dimethyl amine oxide | 4.0% |
| Ethanol | 1.0% |
| Glycerin | 3.5% |
| Citric Acid or Sodium Citrate | To desired pH |
| Preservative | 0.1% |
| Fragrance | 0.4% |
| Deionized water | To 100% |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A natural cleaning composition consisting essentially of:

a. an anionic surfactant selected from the group consisting of a fatty alcohol sulfate, an alkyl α-sulfomethyl ester, a disodium α-sulfo fatty acid salt and combinations thereof;

b. a hydrophilic syndetic selected from the group consisting of $C_6$ alkylpolyglucoside, $C_6$ to $C_8$ alkylpolyglucoside, $C_8$ alkylpolyglucoside, $C_6$ to $C_8$ alkyl sulfate, $C_4$ to $C_8$ alkyl polypentoside and combinations thereof;

c. a nonionic surfactant selected from the group consisting of a $C_8$ to $C_{14}$ alkyl polypentoside, an alkyl poly (glycerol ether), and combinations thereof;

d. a hydrophobic syndetic selected from the group consisting of an amine oxide, an amidoamine oxide, a fatty acid, a fatty alcohol, a sterol, a sorbitan fatty acid ester, a glycerol fatty acid ester, and combinations thereof;

e. optionally, a solvent selected from the group consisting of propylene glycol, 1,3-propanediol, ethanol, sorbitol, glycerol and combinations thereof;

f. optionally an organic chelating agent from the group consisting of 2- hydroxyacids, 2-hydroxyacid derivatives, glutamic acid, glutamic acid derivatives, and mixtures thereof; and g. optional ingredients selected from glycerol, pH adjusting agents, alkanolamines, calcium salts, boric acid, enzymes, dyes, colorants, fragrances, preservatives, fluorescent whitening agents, blueing agents, defoamers, bleaches, thickeners.

2. The composition of claim 1, wherein the composition does not contain alkyl glycol ethers, alcohol alkoxylates, alkyl monoglycerolether sulfate, alkyl ether sulfates, alkanolamines, alkyl ethoxysulfates, phosphates, EDTA, linear alkylbenzene sulfonate ("LAS"), linear alkylbenzene sulphonic acid("HLAS") or nonylphenol ethoxylate ("NPE").

3. The composition of claim 1, wherein the composition is a natural composition, wherein said natural composition has a) at least 95% of the components of the natural composition are derived from plant and mineral based materials;

b) the natural composition is biodegradable;

c) the natural composition is minimally toxic to humans;

d) the natural composition has a LD50 >5000 mg/kg; and e) the natural composition does not contain non-plant based ethoxylated surfactants, linear alkylbenzene sulfonates, ether sulfates surfactants or nonylphenol ethoxylate.

4. The composition of claim 3, the composition is an ecofriendly composition, wherein said ecofriendly composition has a) at least 99% of the components of the ecofriendly composition are derived from plant and mineral based materials;

b) the ecofriendly composition is biodegradable;

c) the ecofriendly composition is minimally toxic to humans;

d) the ecofriendly composition has a LD50>5000 mg/kg; and e) the ecofriendly composition does not contain non-plant based ethoxylated surfactants, linear alkylbenzene sulfonates, ether sulfates surfactants or nonylphenol ethoxylate.

5. The composition of claim 1, wherein the hydrophobic syndetic is a sorbitan fatty acid ester.

6. The composition of claim 1, wherein the hydrophobic syndetic is a glycerol fatty acid ester.

7. A natural cleaning composition comprising:

a. an anionic surfactant selected from the group consisting of sodium lauryl sulfate, sodium alkyl α-sulfomethyl ester, disodium α-sulfo fatty acid salt and combinations thereof;

b. a hydrophilic syndetic selected from the group consisting of $C_6$ alkylpolyglucoside, $C_6$ to $C_8$ alkylpolyglucoside, $C_8$ alkylpolyglucoside, $C_6$ to $C_8$ alkyl sulfate, $C_4$ to $C_8$ polypentoside, and combinations thereof;

c. a nonionic surfactant selected from the group consisting of an alkylpolyglucoside having chain lengths from $C_{10}$ to $C_{20}$, a $C_8$ to $C_{14}$ alkyl polypentoside, an alkyl poly (glycerol ether) and combinations thereof;

d. a hydrophobic syndetic selected from the group consisting of a polyglycerol fatty acid ester, a $C_{14}$ to $C_{22}$ alkyl polypentoside and combinations thereof; and e. optionally, a solvent selected from the group consisting of propylene glycol, 1,3-propanediol, ethanol, sorbitol, glycerol and combinations thereof.

8. The composition of claim 7, wherein the composition does not contain alkyl glycol ethers, alcohol alkoxylates, alkyl monoglycerolether sulfate, alkyl ether sulfates, alkanolamines, alkyl ethoxysulfates, phosphates, EDTA, linear alkylbenzene sulfonate ("LAS"), linear alkylbenzene sulphonic acid("HLAS") or nonylphenol ethoxylate ("NPE").

9. The composition of claim 7, wherein the composition is a natural composition, wherein said natural composition has a) at least 95% of the components of the natural composition are derived from plant and mineral based materials;

b) the natural composition is biodegradable;

c) the natural composition is minimally toxic to humans;

d) the natural composition has a LD50>5000 mg/kg; and e) the natural composition does not contain non-plant based ethoxylated surfactants, linear alkylbenzene sulfonates, ether sulfates surfactants or nonylphenol ethoxylate.

10. The composition of claim 9, the composition is an ecofriendly composition, wherein said ecofriendly composition has a) at least 99% of the components of the ecofriendly composition are derived from plant and mineral based materials;

b) the ecofriendly composition is biodegradable;

c) the ecofriendly composition is minimally toxic to humans;

d) the ecofriendly composition has a LD50>5000 mg/kg; and e) the ecofriendly composition does not contain non-plant based ethoxylated surfactants, linear alkylbenzene sulfonates, ether sulfates surfactants or nonylphenol ethoxylate.

11. The composition of claim 7, wherein the hydrophilic syndetic is a $C_6$ alkyl polyglucoside.

12. The composition of claim 11, wherein the nonionic surfactant is an alkylpolyglucoside having chain lengths from $C_{10}$ to $C_{20}$.

* * * * *